United States Patent [19]

Sakamaki et al.

[11] Patent Number: 4,657,495

[45] Date of Patent: Apr. 14, 1987

[54] ROTOR-SHAFT BEARING APPARATUS FOR ROTARY COMPRESSORS

[75] Inventors: Hiroshi Sakamaki, Utsunomiya; Susumu Sugishita, Hanyu; Yukio Horikoshi, Kazo, all of Japan

[73] Assignee: Nippon Piston Ring Co., Ltd., Tokyo, Japan

[21] Appl. No.: 792,249

[22] Filed: Oct. 30, 1985

Related U.S. Application Data

[63] Continuation of Ser. No. 609,995, May 14, 1984, abandoned.

[30] Foreign Application Priority Data

May 20, 1983 [JP] Japan ..... 58-87738

[51] Int. Cl.[4] ..... F04C 18/344; F04C 29/02; F16C 35/06

[52] U.S. Cl. ..... 418/82; 418/95; 418/104; 384/478

[58] Field of Search ..... 418/75, 76, 79, 81, 418/82, 95, 104; 384/132, 134, 478; 184/5.1

[56] References Cited

U.S. PATENT DOCUMENTS

| | | | |
|---|---|---|---|
| 2,674,953 | 4/1954 | Conde | 418/95 |
| 3,988,080 | 10/1978 | Takada | 418/76 |

FOREIGN PATENT DOCUMENTS

| | | | |
|---|---|---|---|
| 48251 | 1/1934 | Denmark | 418/95 |
| 57-59089 | 4/1982 | Japan | 418/82 |
| 1386836 | 3/1975 | United Kingdom | 418/98 |
| 296902 | 6/1971 | U.S.S.R. | 418/82 |

*Primary Examiner*—John J. Vrablik

*Attorney, Agent, or Firm*—Birch, Stewart, Kolasch & Birch

[57] ABSTRACT

Bearing apparatus for movable vane compressor is provided with a pressure-reducing passage extending from an annular clearance between the inner side surface of the bearing and the side surface of the rotor to the open air or the like, such as the suction-chamber and the suction-working space. Compressed air enters the annular clearance through a gap between the inner side surface of the side housing and the side surface of the rotor from the compression-working space between two adjacent vanes and then runs out through the pressure-reducing passage without pushing the bearing grease from the bearing.

1 Claim, 4 Drawing Figures

ROTOR-SHAFT BEARING APPARATUS FOR ROTARY COMPRESSORS

This application is a continuation of application Ser. No. 609,995 filed on May 14, 1984, now abandoned.

BACKGROUND OF THE INVENTION

1. Field of the Invention

The present invention relates to bearing apparatus for supporting a rotor shaft of a rotary compressor provided with a housing, a rotor contained in the housing, a plurality of vanes movably fitted in the rotor.

2. Description of the Prior Art

In general, a compressor has a rotor shaft rotatably supported by a bearing with grease lubrication. However, the bearing has a relatively short life. This is a fatal defect for the movable vane compressor used as a supercharger in an automobile engine. The short life results from poor lubrication or lack of bearing grease in the bearing.

Air is compressed within the compression working space between two adjacent vanes in the compressor. A part of the compressed air enters an annular clearance between the inner side surface of the bearing and the side surface of the rotor and, then, passes through the bearing to push the grease outwardly therefrom, resulting in that the bearing is poor in lubrication due to a lack of bearing grease.

SUMMARY OF THE INVENTION

It is an object of the invention to provide rotor-shaft bearing apparatus in which the bearing is relatively long in life and free from a lack of grease.

Another object of the invention is to provide rotor-shaft bearing apparatus that is especially suitable to a movable vane compressor used as a supercharger for an automobile engine.

To attain the object as described above, the apparatus of the invention has means for reducing air pressure in an annular clearance between the inner side surface of the bearing on the rotor shaft and the side surface of the rotor, the means comprising a pressure-reducing passage extending from the clearance to the open air or the like, such as the suction chamber.

As the compressor rotates, a part of compressed air flows from the compression-working space to an annular clearance between the inner side surface of the bearing on the rotor-shaft and the side surface of the rotor through a gap between the inner side surface of the side housing and the side surface of the rotor and then escapes to the open air or the like such as the suction chamber and the suction-working space between the adjacent vanes through the pressure-reducing passage. Therefore, the air pressure in the clearance is reduced to the extent that it is too small to push the grease out of the bearing.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The present invention will now be described in detail below with reference to drawings wherein like numbers are used in the various views to indicate identical elements.

Figure 1:
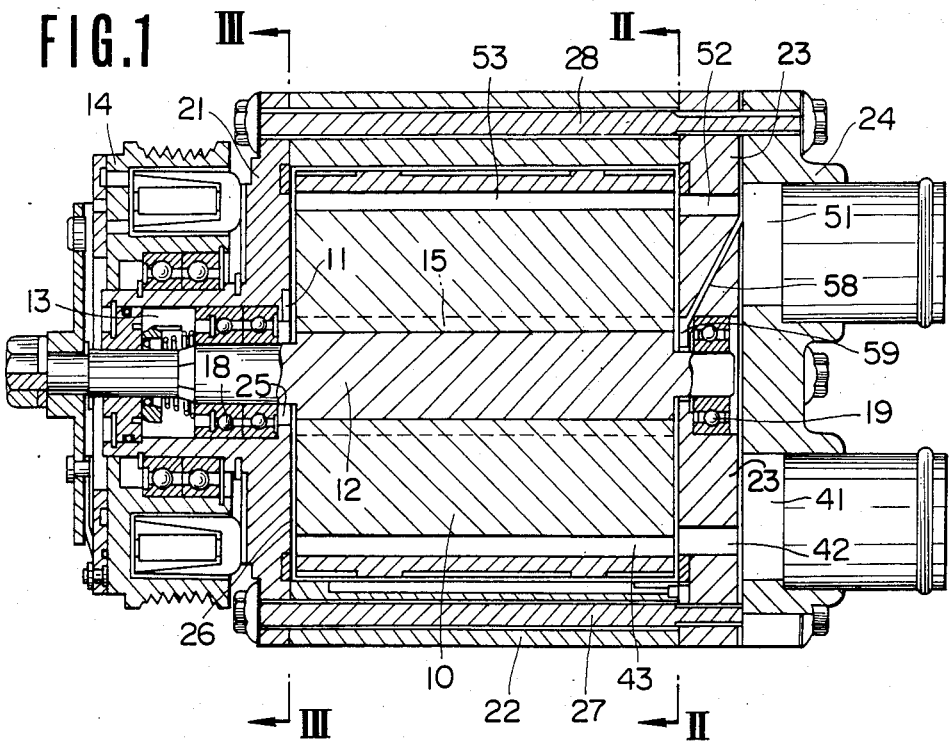
FIG. 1 is a longitudinal section of a movable vane compressor provided with the apparatus according to the present invention.

As seen in FIG. 1, the rotor 10 is integrally shaped with a shaft 12 which is rotatably supported by bearings 18, 19 in the respective front and rear side housings 21, 23. The shaft 12 is fixed at the front end thereof to a pulley 14 which is rotated by an engine. The rotor 10 has a plurality of vane grooves 15 shown by dotted lines in which the respective vanes are radially slidably fitted. A gasket is interposed between the rear side housing 23 and the rear cover 24 in which the discharge chamber 41 and the suction chamber 51 are provided. The discharge chamber 41 is internally connected to a compression-working space 43 through a discharge port 42. The suction chamber 51 is internally connected to a suction side working space 53 through a suction port 52. The front and rear side housings 21, 23, a center housing 22 therebetween and the rear cover 24 are tightly connected as one body by bolts 28.

The compressor of FIG. 1 is of side-port type to have its suction and discharge ports provided in the same side housing 23. The bearing 19 has its outer race supported by the rear side housing 23 and is completely sealed by the rear cover 24. There is no pressure difference to push the bearing grease axially therefrom between the inner and outer sides of the bearing 19. The bearing 18 has the inner race thereof fixed to the rotor-shaft 12 and the outer race supported by the front side housing 21. It has its outer side joined with a mechanical seal 13 which is internally connected to the open air. The inner side surface of the bearing 18 and the side surface of the rotor 10 face to each other to form an annular clearance 25 therebetween. The clearance 25 is peripherally connected to a gap 26 between the side surface of the rotor 10 and the inner side surface of the side housing 21 in which an air-accumulating groove 11 is formed. As the rotor 10 rotates, air is compressed in the compression-working space 43, thereby a part of compressed air entering the air-accumulating groove 11 through the gap 26 from the compression-working space.

Figure 2:
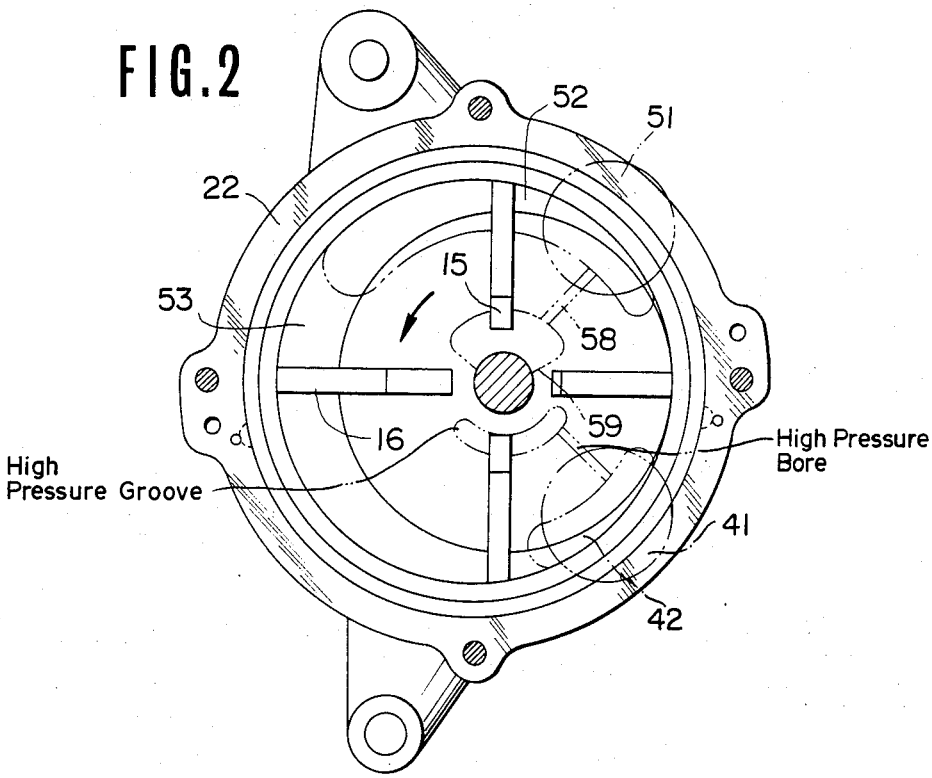
FIGS. 2 and 3 are somewhat enlarged sections taken along lines II—II and III—III of FIG. 1, respectively.
Figure 3:
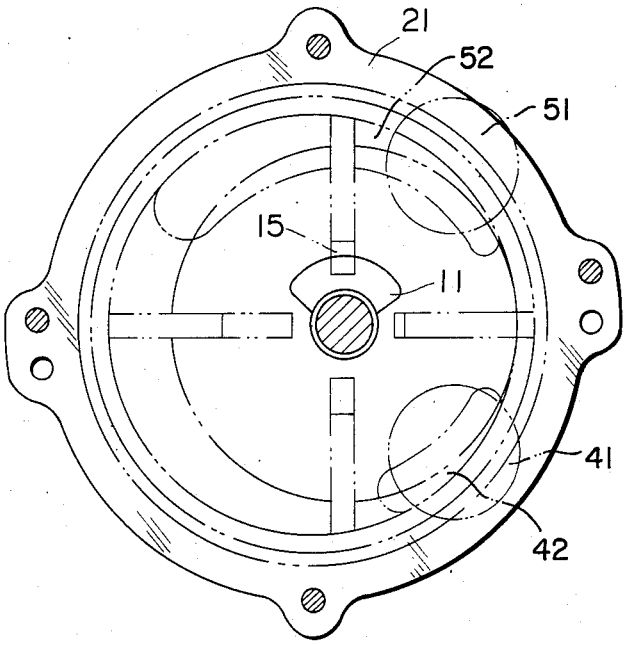

As seen in FIG. 3, the air-accumulating groove 11 is fan-shaped in the suction-side inner surface of the front side housing 21 to cross at least a vane groove 15 shown by imaginal lines. As shown in FIG. 1 and by imaginal lines in FIG. 2, the vane groove 15 also crosses a fan-shaped low-pressure groove 59 which is internally connected to the suction port 52 through a low-pressure bore 58. The suction port 52 leads both to the suction chamber 51 and to the suction-working space 53 defined by two adjacent vanes 16 in the suction side of the center housing 22. Thus, a pressure-reducing passage extends from the clearance 25 to the suction port 52 through the air-accumulating groove 11 in the front side housing 21, the vane groove 15 in the rotor 10, the low-pressure groove 59 and the low pressure bore 58 to reduce air-pressure in the clearance 25 down to that in the suction chamber 51, as seen in FIG. 1. Therefore, the air, passing through the bearing 18 from the clearance 25 to the mechanical seal 13, is too low in pressure and small in volume to push the bearing grease out of the bearing 18.

Figure 4:
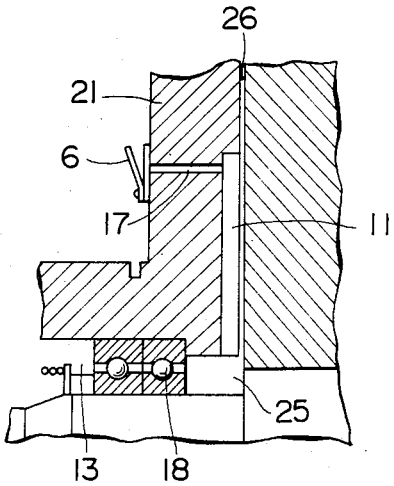
FIG. 4 is an enlarged longitudinal section of a relevant part of another embodiment, showing an air-accumulating groove.

In the case of the compressor of the type having no vane groove connected to the suction port, as seen in FIG. 4, there is provided, as a pressure-reducing passage, a vent 17 which extends from the air-accumulating groove 11 through the front side housing 21 to the open air. The compressed air enters the air-accumulating groove 11 through a gap 26 between the inner side surface of the side housing 21 and the side surface of the rotor 10 and runs out to the open air through a vent 17, so that the air pressure in the clearance 25 is lowered to the atmospheric pressure. A check valve 6, such as a reed valve, is provided to prevent dust or water from entering the vent 17. The air, passing through the bearing 18 from the clearance 25 to the mechanical seal room 13, has neither volume nor pressure to push the bearing grease out of the bearing 18 in the same way as in the previous embodiment.

From the foregoing, the apparatus of the present invention is provided with a pressure-reducing passage to allow the clearance between the inner side surface of the bearing and the side surface of the rotor to permanently have the same pressure as the open air, so that no air pushes bearing grease out of the bearing. As compared with the known apparatus without a pressure-reducing passage, the inventive apparatus is free from seizing trouble because of always having a plenty of bearing grease. It will be understood that the apparatus of the invention allows the movable vane compressor to be used as a supercharger for an automobile engine.

What is claimed is:

1. A rotor-shaft bearing apparatus for a rotary compressor having a housing, a rotor contained in said housing, said rotor having a side surface, a rotor shaft fixed to said rotor, a plurality of vane grooves formed in said rotor, means forming a suction chamber for said compressor, said apparatus comprising a grease bearing interposed between said rotor shaft and said housing, said bearing having an outer side surface and an inner side surface, a mechanical seal joined with the outer side surface of said bearing, a pressure-reducing passage for exhausting an annular clearance between the inner side surface of said bearing and the side surface of said rotor to said suction chamber to reduce a pressure difference between the inner and outer side surfaces of said bearing, said pressure-reducing passage comprising an air-accumulating groove formed in a suction side, inner surface of one side of said housing, a low-pressure groove formed in an other side of said housing and internally connected to said air-accumulating groove through at least one of said vane grooves, and a low-pressure bore formed in the other side of said housing and internally connected to said suction chamber.

* * * * *